US005689772A

United States Patent [19]

Fujiwara et al.

[11] Patent Number: 5,689,772

[45] Date of Patent: Nov. 18, 1997

[54] FRAME, DEVELOPING APPARATUS, PROCESS CARTRIDGE AND ELECTROPHOTOGRAPHIC IMAGE FORMING APPARATUS HAVING A TONER FRAME AND A DEVELOPING FRAME COUPLED THERETO

[75] Inventors: Yasuo Fujiwara, Urawa; Satoshi Kurihara, Tokyo, both of Japan

[73] Assignee: Canon Kabushiki Kaisha, Tokyo, Japan

[21] Appl. No.: 502,290

[22] Filed: Jul. 13, 1995

[30] Foreign Application Priority Data

Jul. 15, 1994 [JP] Japan ..... 6-163567

[51] Int. Cl.[6] ..... G03G 15/00; G03G 15/08

[52] U.S. Cl. ..... 399/106; 399/113

[58] Field of Search ..... 355/210, 245, 355/260; 399/103, 106, 109, 113

[56] References Cited

U.S. PATENT DOCUMENTS 5,446,525 8/1995 Kobayashi ..... 355/210

*Primary Examiner*—Joan H. Pendegrass

*Attorney, Agent, or Firm*—Fitzpatrick, Cella, Harper & Scinto

[57] ABSTRACT

A frame for a developing device for a process cartridge detachably mountable to a main assembly of an image forming apparatus, includes a developing frame having a mounting portion for mounting a developing roller for developing a latent image formed on an electrophotographic photosensitive member, the developing frame having a projection on a side opposed from a side provided with the mounting portion; a toner frame having a toner container portion for containing a toner usable for developing operation of the developing roller, the toner frame having an opening for supplying toner to the developing roller and a recess adjacent a longitudinal end of the opening; wherein the projection and recess are engageable with each other to couple the developing frame and the toner frame.

47 Claims, 7 Drawing Sheets

FRAME, DEVELOPING APPARATUS, PROCESS CARTRIDGE AND ELECTRO-PHOTOGRAPHIC IMAGE FORMING APPARATUS HAVING A TONER FRAME AND A DEVELOPING FRAME COUPLED THERETO

FIELD OF THE INVENTION

The present invention relates to a frame, a developing apparatus, a process cartridge, and an electro-photographic image forming apparatus.

The electro-photographic image forming apparatus mentioned in the foregoing refers to an electro-photographic copying machine, a laser beam printer, a facsimile apparatus, a word processor, and the like.

DESCRIPTION OF THE RELATED ART

A conventional image forming apparatus based on the electro-photographic image forming process employs a process cartridge system, in which an electro-photographic photosensitive material, and a processing means that works with the electro-photographic photosensitive material, are integrated into a form of cassette which is replaceably mountable in an image forming apparatus. According to this process cartridge system, a user can maintain his apparatus by himself without relying on service personnel; therefore, it is possible to improve substantially the operational efficiency of the apparatus. Thus, this process cartridge system has come to be widely employed in the image forming apparatus.

The frame of the developing apparatus in the process cartridge comprises a toner storing container (toner frame) and a developing frame, which are joined by the ultrasonic welding or the like means. The opening of the former is sealed with a sealing member, or is sealed by means of interposing between the toner storing container and developing frame, an opening regulating member, the opening of which is sealed with the sealing member. When the process cartridge is put to use, the sealing member is pulled out by an operator to unseal the opening, so that the toner having been sealed in the toner storing container can be supplied into a developing means.

However, the frame design described above suffers from the following liability; unless the toner storing container (toner frame) and developing frame are precisely aligned, the toner cannot be smoothly supplied to the developing means.

SUMMARY OF THE INVENTION

The primary object of the present invention is to provide: a developing apparatus frame comprising a developing frame and a toner frame, which can be easily joined together; a developing apparatus comprising such a developing frame; a process cartridge comprising such a developing apparatus; and an image forming apparatus usable with such a process cartridge.

Another object of the present invention is to provide: a developing frame comprising a developing frame and a toner frame, which can be easily aligned when joined; a developing apparatus comprising such a developing frame; a process cartridge comprising such a developing apparatus; and an image forming apparatus usable with such a process cartridge.

Another object of the present invention is to provide a developing apparatus frame, in which the toner can be smoothly supplied from the toner frame to the developing frame; a developing apparatus comprising such a developing apparatus frame; a process cartridge comprising such a developing apparatus; and an image forming apparatus usable with such a process cartridge.

Another object of the present invention is to provide a developing apparatus frame capable of preventing the toner from leaking from between the toner frame and developing frame; a developing apparatus comprising such a developing apparatus frame; a process cartridge comprising such a developing apparatus; and an image forming apparatus usable with such a process cartridge.

Another object of the present invention is to provide: a developing apparatus frame, which comprises an easily and reliably joinable toner frame and developing frame, and is capable of reliably preventing the toner leak; a developing apparatus comprising such a developing apparatus frame; a process cartridge comprising such a developing apparatus; and an image forming apparatus, in which such a process cartridge is replaceable mountable.

Another object of the present invention is to provide a developing apparatus frame comprising a projection and a recess, which are engaged when the toner frame and developing frame are joined; a developing apparatus comprising such a developing apparatus frame; a process cartridge comprising such a developing apparatus; and an image forming apparatus usable with such a process cartridge.

These and other objects, features and advantages of the present invention will become more apparent upon a consideration of the following description of the preferred embodiments of the present invention, taken in conjunction with the accompanying drawings.

DESCRIPTION OF THE PREFERRED EMBODIMENTS

Hereinafter, the embodiments of the present invention will be described with reference to the drawings.

As for the embodiment of a typical structure in accordance with the present invention, a developing apparatus frame, a developing apparatus comprising a developing apparatus frame, a process cartridge comprising a developing apparatus, or an image forming apparatus comprising a cartridge, comprises: a toner storing container (toner frame) provided with an opening; a sealing member, which seals the opening of the toner storing container, and unseals the opening as it is pulled out by an operator when the cartridge is put to use; and a developing frame, which is joined with the toner storing container in such a manner that the free end of the sealing member is allowed to stick out of the frame; wherein the apparatus frame further comprises an engagement guide, which is disposed on the toner storing container and/or developing frame, on the side from which the free end of the sealing member sticks out, in order to guide the toner storing container and developing frame when they are joined.

According to the structure described above, an engagement guide is disposed on the toner storing container and/or developing frame, at their edges where they are joined; therefore, the two frames can be easily and reliably joined, and also, the liability of the toner leak can be eliminated.

Next, as a preferred embodiment of the present invention, an image forming apparatus, in which a process cartridge comprising a developing apparatus is removably mountable, will be described in detail with reference to the drawings.

Embodiment 1

Figure 1:
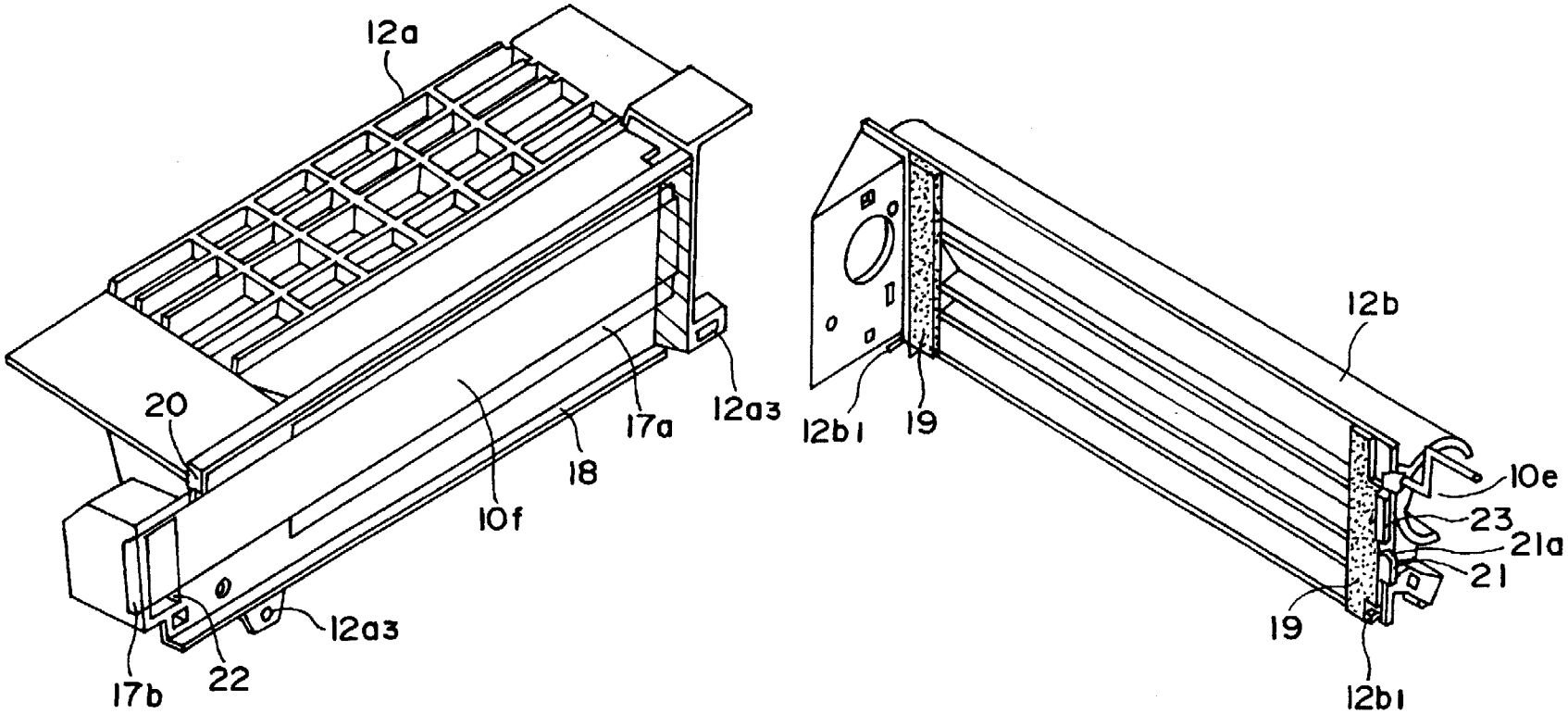
FIG. 1 is a perspective explanatory drawing that illustrates the first embodiment of the toner storing member (toner frame) and developing frame in accordance with the present invention, wherein the two components have been separated from each other.
Figure 2:
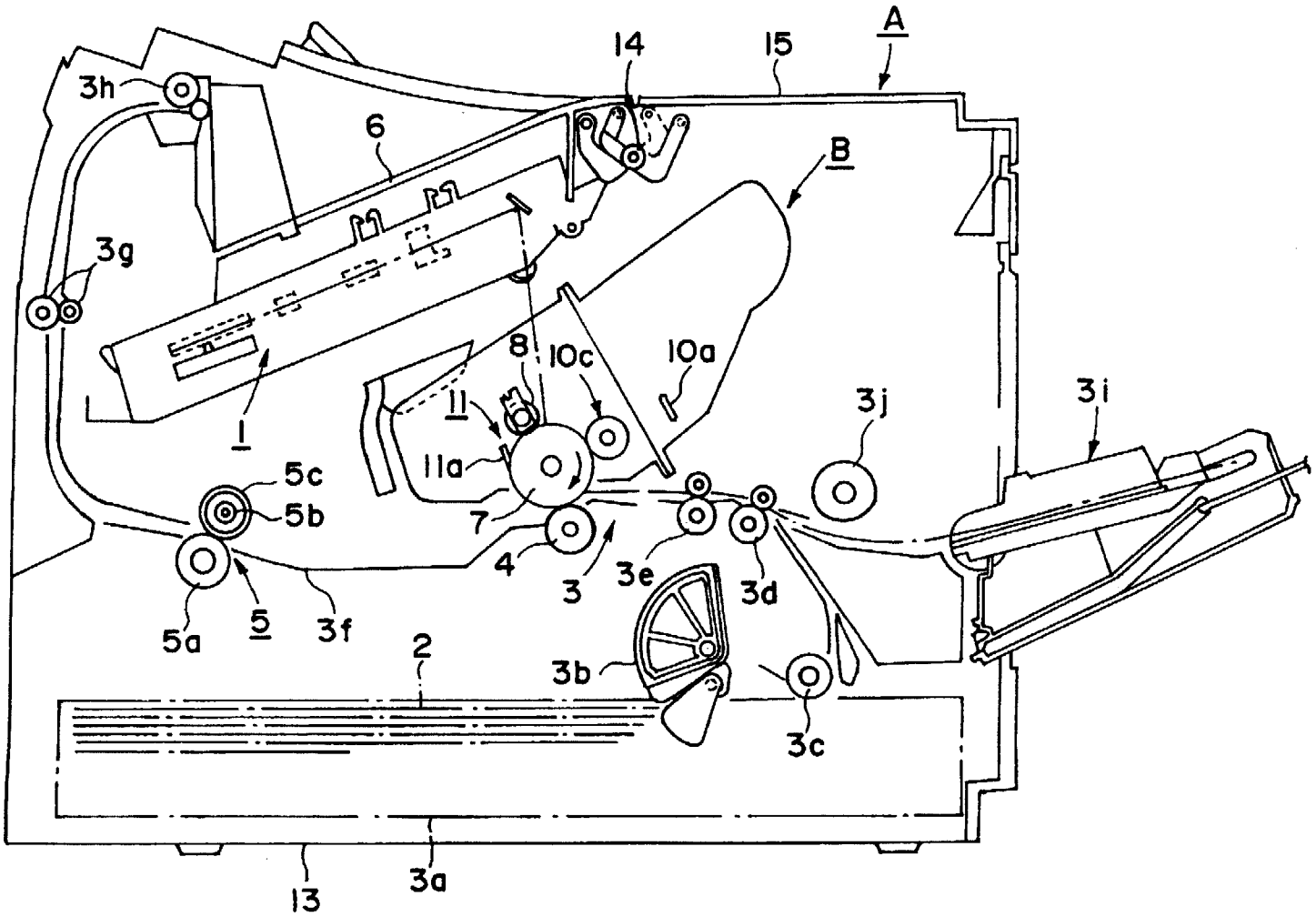
FIG. 2 is a sectional view of the structure of an electro-photographic image forming apparatus, in which a process cartridge has been mounted.
Figure 3:
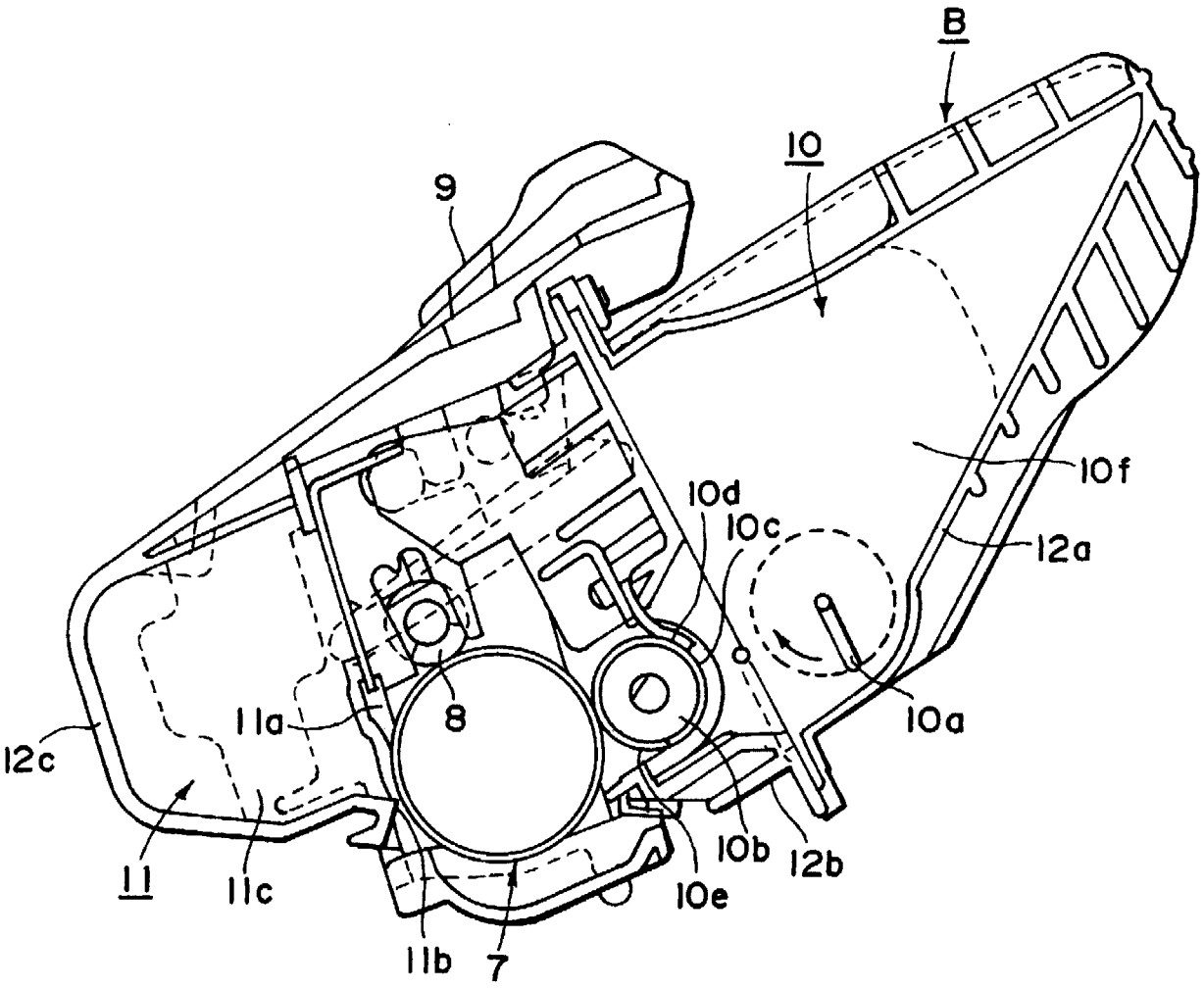
FIG. 3 is a sectional view of the structure of a process cartridge.
Figure 4:
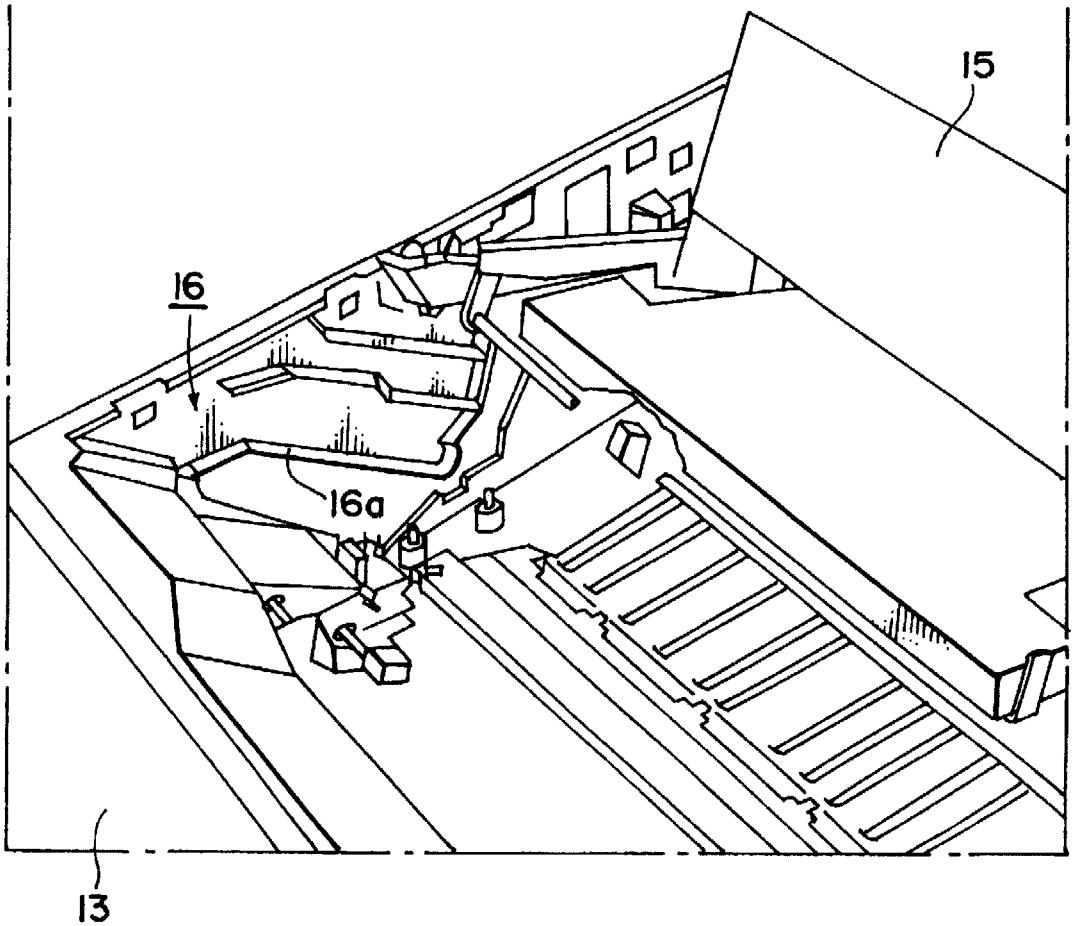
FIG. 4 is a perspective view of the portion of the structure for accommodating the process cartridge.
Figure 5:
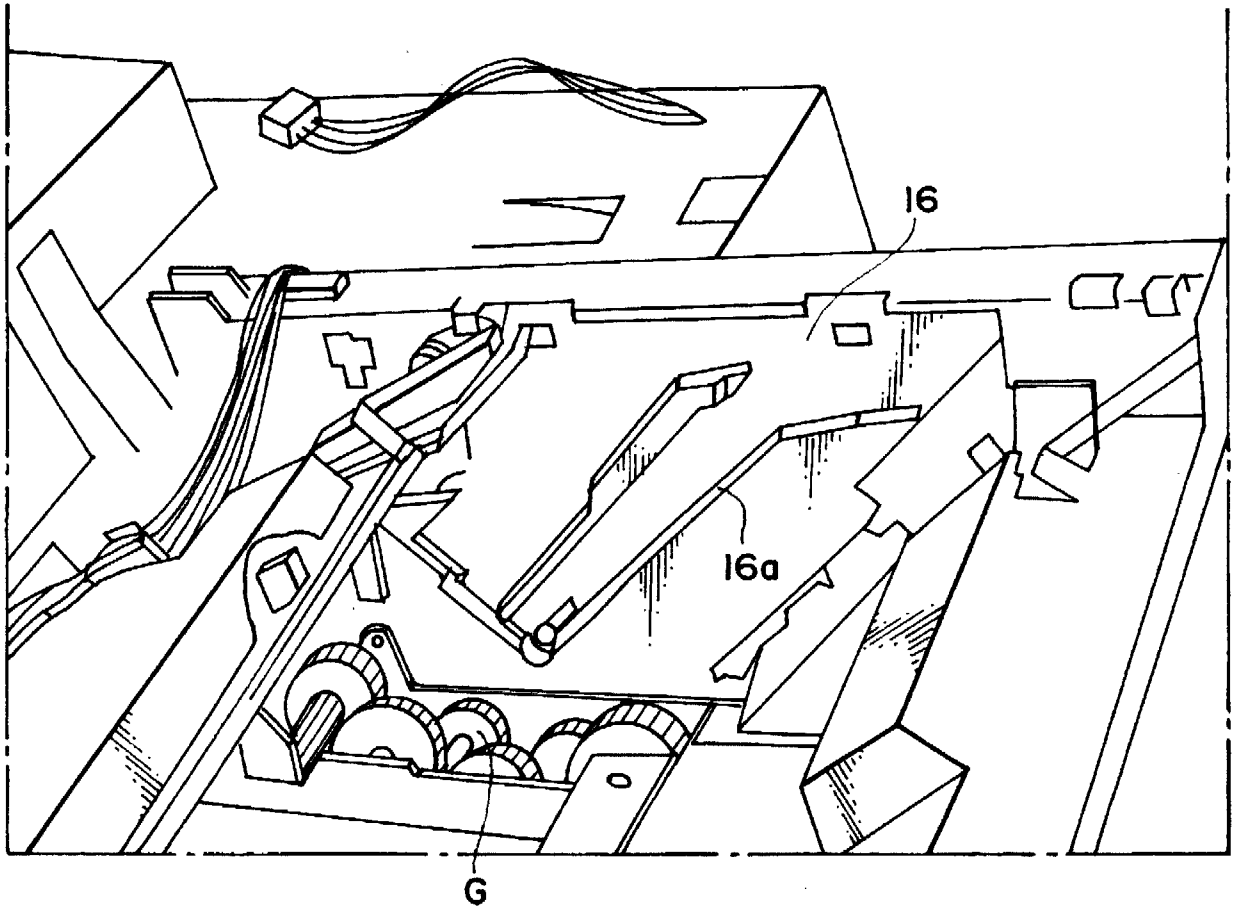
FIG. 5 is a perspective view of another portion of the structure for accommodating the process cartridge.
Figure 6:
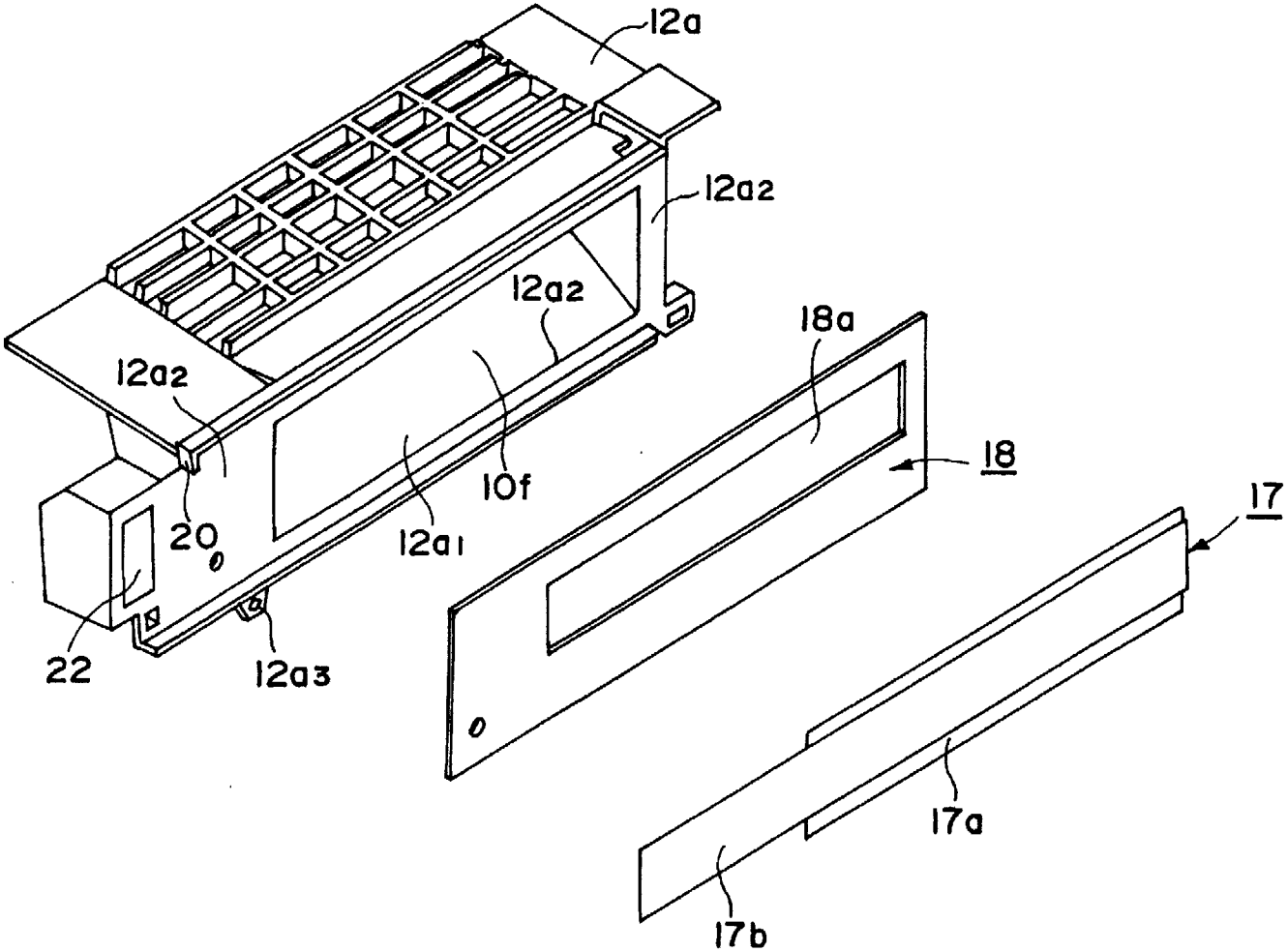
FIG. 6 is a perspective drawing illustrating the toner storing container (toner frame), the opening regulating member, and the sealing member, which have been separated from each other.
Figure 7:
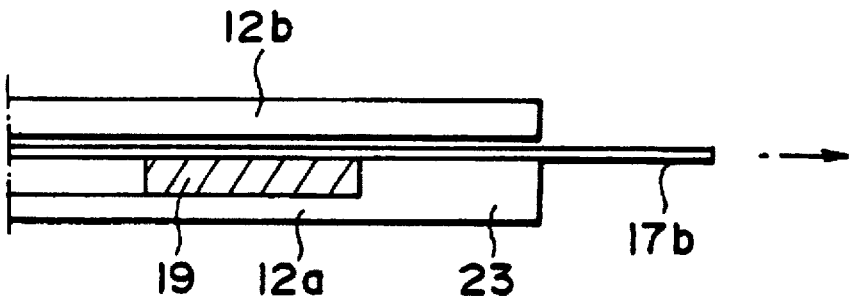
FIG. 7 is a sectional view of a projection provided on the downstream side of an end seal, relative to the direction in which the sealing member is pulled out.
Figure 8A:
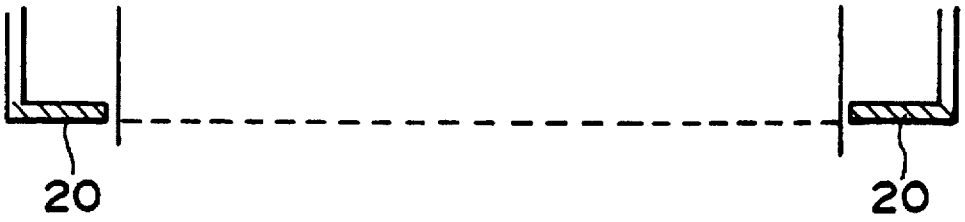
FIG. 8(*a*) is a plan view of an exterior wall member provided at the corner portion of the toner storing container (toner frame), and FIG. 8(*b*) is the side view thereof.
Figure 8B:
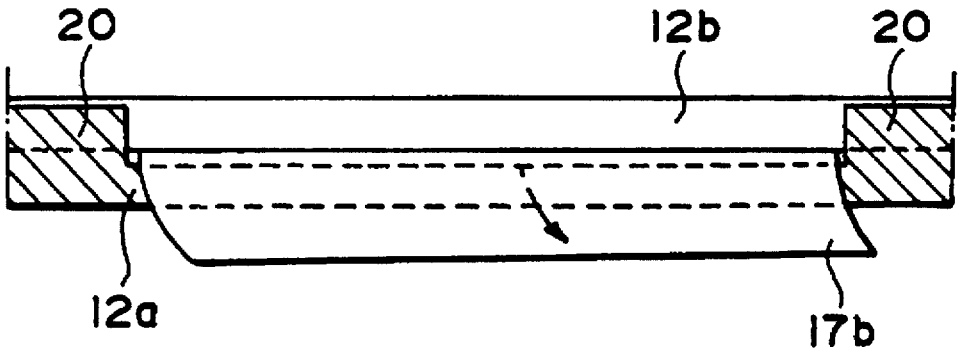

Referring to FIGS. 1–8, the first embodiment of the present invention will be described. FIG. 1 is a perspective drawing illustrating the toner frame (hereinafter, toner storing container) and developing frame, which have been separated from each other; FIG. 2, a sectional view of an electro-photographic image forming apparatus, in which a process cartridge has been mounted; and FIG. 3, a sectional view of the structure of the process cartridge; FIGS. 4 and 5 are perspective views of the different portions of the structure for accommodating the process cartridge; and FIGS. 6–8 are a perspective view, a plan view, and a sectional view, of the cassette portions, respectively, from which the sealing member is pulled out.

As for the order of the descriptions, the process cartridge, and the image forming apparatus containing the process cartridge, are first described in terms of the general structure with reference to FIGS. 2–5, and then, the structure for joining the toner storing container and developing frame will be described with reference to FIGS. 1 and FIGS. 6–8.

{General Structure}

Referring to FIG. 2, In this electro-photographic image forming apparatus A, a laser beam carrying imaging information is projected from an optical system 1 onto a photosensitive drum 7, which is an image bearing member, forming thereby a latent image thereon, and then, this latent image is developed into a toner image, with the toner. Meanwhile, a recording medium 2 is fed out of a cassette 3 by a pickup roller **3*b* and a feeder roller 3*c*, and conveyed by a conveying means 3 comprising a conveyer roller 3*d*, a register roller 3*e*, and the like, in synchronism with the toner image. Next, as a voltage is applied to a transfer roller 4 provided as a transferring means in the apparatus A, the toner image formed on the photosensitive drum, which the process cartridge comprises, is transferred onto the recording medium 2. Thereafter, the recording medium 2 is conveyed, being guided by a guide plate 3*f*, to a fixing means 5. This fixing means 5, comprising a driving roller 5*a*, and a fixing roller containing a heater 5*b*, applies heat and pressure to the recording medium 2 as it is passed through the fixing means 5, whereby the transferred toner image is fixed. This recording medium 2 now carrying the fixed toner image is conveyed through a reverse conveyance path by a pair of discharge rollers 3*g* and 3*h*, being subsequently discharged into a discharge portion 6. It should be noted here that in the case of the image forming apparatus A, it is possible to manually feed the recording medium 2 using a manual feeding tray 3*i* in conjunction with a roller 3*j***.

Referring to FIGS. 2 and 3, in the process cartridge B, the photosensitive drum 7 provided with a photosensitive layer is rotated, and as it is rotated, the surface thereof is uniformly charged by means of applying a voltage to a charging roller 8, that is, a charging means. The surface of the photosensitive drum 7 thus charged is exposed to an optical image projected from the optical system through an opening 9, whereby a latent image is formed on the photosensitive drum 7. This latent image is developed by a developing means 10.

In the developing means 10, the toner in the toner reservoir is sent out by the rotation of the toner feeding member **10*a*, and as a developing roller 10*c* containing a stationary magnet 10*b* is rotated, it forms a toner layer on the surface of a developing roller 10*c* having been triboelectrically charged with a developing blade 10*d*. Then, the toner in the toner layer is supplied onto the photosensitive drum 7 in correspondence with the latent image, whereby the latent image is visualized as a toner image. Next, a voltage having a reverse polarity to the toner image is applied to a transfer roller 4, whereby the toner image is transferred onto a recording medium 2. Thereafter, the toner remaining on the photosensitive drum 7 is removed by a cleaning means 11; it is scraped off by a cleaning blade 11*a*, is scooped up by a scooping sheet 11*b*, and is collected into a waste toner bin 11*c***.

The developing frame comprises a toner storing container or toner frame **12*a* for storing the toner, and a developing frame 12*b* for holding developing members such as the developing roller 10*c*, wherein the two components are integrally welded together. To this integral frame of the developing apparatus, a cleaning means container 12*c* holding the photosensitive drum 7, the cleaning blade 11*a*, and the like, is joined to complete a process cartridge B, which is replaceably mounted on the cartridge mounting means provided in the main assembly 13** of the recording apparatus.

As a movable cover 15 mounted on the apparatus main assembly A is rotated open about an axis 14, the cartridge mounting means is exposed, which comprises right and left cartridge mounting guide members mounted, facing each other, on the right and left side internal surfaces, respectively, of the cartridge accommodating space (right side guide member). Each of the right and left guide members 16 is provided with a guide portion **16*a*, which faces its counterpart on the opposing side and serves as a guide when the process cartridge B is inserted. As the movable cover 15 is closed after the process cartridge B is inserted along this guide 16*a*, the process cartridge B is mounted in the image forming apparatus A. As the process cartridge B is mounted in the manner described above, a drum gear (unillustrated) attached at one of the longitudinal ends of the photosensitive drum 7 is engaged with a driving force conveying gear G (FIG. 5) provided on the apparatus main assembly 13, so that the driving force can be transmitted to the photosensitive drum 7**.

{Structure for joining Toner Container and Developing Frame}

Next, the structure for joining the toner container and developing frame will be described.

Referring to FIG. 6, the toner storing container **12*a* is provided with an opening 12*a*1**, which is surrounded with a flange 12a2, and is to be openably sealed with a sealing member 17, wherein in this embodiment, the opening 12a1 is sealed by means of mounting first the sealing member 17 on an opening regulating member 18, and then, attaching the opening regulating member 18 to the flange 12a2. After the toner storing container 12a is sealed, it is joined with the developing frame 12b.

The sealing member 17 is a tearable sealing member, and integrally comprises a piece of cover film 17a, which is an actual covering member, and a piece of tear tape 17b, which is a flexible member; wherein the two pieces are attached by welding or the like means. The cover film 17a is made of a sheet of monoaxially stretched film material, such as monoaxially stretched polyethylene, monoaxially stretched polypropylene, monoaxially stretched foamed polypropylene, or the like, which is sufficiently airtight, and also, is easily tearable in one direction.

It is necessary for the tear tape 17b to have enough strength to tear the cover film 17a; it is preferred to have approximately three times the tensile strength of the cover film 17a. As for the material therefor, various film or sheet materials, such as biaxially stretched polyester, biaxially stretched polypropylene, polystyrene, biaxially stretched nylon, or the like, are preferable.

The sealing member 17 is formed by means of welding integrally the tear tape 17b onto the cover film 17a. More specifically, the sealing member 17 comprises the cover film 17a, and the tear tape 17b which is extended from one of the longitudinal ends of the cover film 17a to the other, and then, is folded back to the first end.

The opening regulating member 18, on which sealing member 17 is to be mounted, regulates the size of the opening through which the toner is supplied from the toner storing container 12a to the developing roller 10c. It is composed of polyester, polystyrene, nylon, ABS, or the like material, and the frame-like configuration thereof is formed by means of cutting the opening portion 18a in an approximately 0.3–2.0 mm thick piece of sheet-molded plate of the above mentioned material, or is simply molded in an ordinary manner. The sealing member 17 is thermally sealed to the opening regulating member 18 by discharging corona or the like means, closing thereby the opening 18a, and then, the opening regulating member 18, the opening 18a of which has been sealed with the sealing means 17, is thermally welded to the flange 12a2 of the toner storing container 12a.

The toner storing container 12a, the opening 12a1 of which has been sealed as described in the foregoing, is joined with the developing frame 12b; the two components are welded together across their longer edges, using ultrasonic waves or the like, which eliminates such a liability that the toner might leak from along the longer edges of the toner storing container 12a and developing frame 12b. However, they cannot be welded together along their shorter edges (longitudinal ends) since the sealing member 17 needs to be exposed at one of the shorter edge sides so that the tear tape 17b can be pulled out to unseal the opening 18a. Therefore, in order to prevent the toner from leaking at the shorter edges of the joined toner storing container 12a and developing frame 12b, an end seal 19, which is composed of foamed polyurethane, foamed polyethylene, foamed polypropylene, or the like, is pasted on the back surface of the developing frame 12b, at each of their longitudinal ends, as shown in FIG. 1.

The end seal 19 is generally 2–5 mm thick, and is compressed to approximately ⅓–½ of the original thickness as the developing frame 12b is joined with the toner storing container 12a, whereby the toner is prevented from leaking after the sealing member 17 is unsealed.

Referring to FIG. 1, in this embodiment, in order to make it easier to join the toner storing container 12a and developing frame 12b, and to improve the angle at which the tear tape 17b is to be pulled out, an external wall member 20 is provided on the toner storing container 12a, at a corner of the longitudinal end from which the tear tape 17b is pulled out, and in addition, an engagement guide projection 21 is provided on the developing frame 12b, on the same longitudinal end. Further, the toner storing container 12a is provided with a blind hole in which the guide projection 21 is fitted.

The exterior wall member 20 is integrally formed with the toner storing container 12a, and the guide projection 21 is integrally formed with the developing frame 12b. On the side from which the tear tape is pulled out, the distance between the exterior wall member 20 and guide projection 21 is substantially the same (slightly wider) as the width of the tear tape 17b. Therefore, after the toner storing container 12a and developing frame 12b are joined, the exterior wall member 20 or guide projection 21 is substantially 1–3 mm away from the corresponding edge of the tear tape 17b (in the width direction of the tape).

With the above arrangement in place, when an attempt is made to pull out the tear tape 17b, the edges of the tear tape 17b in the width direction thereof are guided by the external wall member 20 and guide projection 21, respectively, which makes it easier to pull the tear tape 17b in the proper direction for unsealing the opening. It should be noted here that the projection 21 is preferred to be rounded, on the side facing the tear tape, so as to reduce its resistance to the tear tape 17b when the tape 17b is pulled out.

Further, the exterior wall member 20, guide projection 21, and blind hole 22 serve as an engagement guide when the toner storing container 12a and developing frame 12b are joined. In other words, when the toner storing container 12a and developing frame 12b are joined, the corner portion of the developing frame 12b is abutted with the external wall member 20, and the guide projection 21 of the developing frame 12b is fitted into the blind hole 22 of the toner storing container 12a. Therefore, the toner storing container 12a and developing frame 12b are smoothly joined without being misaligned. In addition, the corner portion of the developing frame 12b abuts with the inward facing surface of the exterior wall member 20, being thereby protected by the member 20; therefore, even when the process cartridge B is dropped, or subjected to the like incidence, during its transportation, the impact to the corner portion is eased.

Also, in this embodiment, as is illustrated in FIG. 1, a jaw-like projection 23 is provided on the developing frame 12b, on the downstream side of the guide projection 21 provided on the side from which the free end of the tear tape sticks out, relative to the direction in which the tear tape 17b is pulled out. This jaw-like projection 23 is integrally formed with the developing frame 12b.

The jaw-like projection 23 is provided in the region from which the tear tape 17b is pulled out, and the gap, which is created between the toner storing container 12a and jaw-like projection 23 after the toner storing container 12a and developing frame 12b are joined as illustrated in FIG. 7, is made as small as possible within the limits of not increasing the opening (pulling) resistance when the tear tape 17b is pulled. With this arrangement, it becomes more difficult for the toner to leak out through the gap when the tear taped is pulled out by an operator; in other words, the cartridge is better sealed against the toner leak.

As for the gap between the aforementioned jaw-like projection 23 and toner storing container 12*a*, it is preferred to be approximately 0.4–0.8 mm, more preferably, 0.4–0.6 mm, so that the toner leak can be prevented without interfering with the easily pullable properties of the tear tape 17*b*. In this embodiment, it is set at 0.55 mm.

Also, referring to FIG. 1, in this embodiment, in order to reliably align the toner storing container 12*a* and developing frame 12*b* when they are joined, an engagement hole 12*a*3 is provided at the bottom edge of the toner storing container 12*a*, and a boss 12*b*l, which is to be fitted into the engagement hole 12*a*3, is provided at the bottom edge of the developing frame 12*b*.

In summary, referring to FIGS. 1 and 6, the frame of the developing apparatus employed in the process cartridge, which is removably mountable in the main assembly of the electro-photographic image forming apparatus described in the preceding embodiment, comprises the developing frame 12*b* and toner frame 12*a*, the former having a mount 10*e*, on which the developing means 10*c* for developing the latent image formed on the electro-photographic photosensitive member is mounted, and the projection 21, which is provided on the side opposite to the side where the developing means 10 is provided, and the latter having a toner storing portion 10*f* for storing the toner to be used for the development by the developing means 10*c*, a toner supplying opening 12*a*1, through which the toner stored in the toner storing portion 10*f* is supplied to the developing means 10*c*, and the blind hole 22 provided at one of the longitudinal ends of the toner supplying opening 12*a*1;

When the developing frame 12*b* and toner frame 12*a* are joined, the projection 21 and blind hole 22 are are engaged, and the projection 21 is provided on the developing frame 12*b*, on the outward side of one of the elastic sealing members 19 which are disposed at the corresponding longitudinal ends of the developing frame 12*b* in order to prevent the toner from leaking from between the developing frame 12*b* and toner frame 12*a* after joining them.

The toner frame 12*a* is provided with a toner seal 17 for sealing the toner supply opening 12*a*1, the aforementioned blind hole being disposed on the downstream side of the toner supplying opening 12*a*1 relative to the direction in which the toner seal 17 is to be pulled to open the toner supplying opening 12*a*1 before the process cartridge is put to use.

The toner seal 17 is mounted on the regulating plate for regulating the size of the toner supplying opening, and is indirectly mounted on the toner frame 12*a* by mounting the regulating plate on the toner frame 12*a*.

The toner seal 17 comprises the cover film 17*a* for sealing the toner supplying opening 12*a*1, and the tear tape 17*b* for tearing open the cover film 17*a*.

The toner seal 17 is pulled out from between the joined developing frame 12*b* and toner frame 12*a*, being guided by the projection 21 having engaged with the blind hole 22, wherein the corner 21*a* of the projection 21 that comes in contact with the toner seal 17 is rounded.

the developing frame 12*b* and toner frame 12*a* are joined using ultrasonic welding.

{Other Embodiments}

In the first embodiment described above, the exterior wall member 20 and engagement guide projection 21 are provided, as the engagement guides, on the toner storing container 12*a* and developing frame 12*b*, respectively. However, both the exterior member 20 and guide projection 21 may be provided on one of the two components, that is, on the same component.

Also, in the first embodiment, only one exterior wall member 20 was provided on the toner storing container 12*a*, on the side from which the tear tape is pulled out, so as to control one of the lateral edges of the tear tape. However, another exterior wall member 20 may be provided on the same longitudinal end of the toner storing container 12*a*, as shown in FIG. 8, so as to control the other lateral edge of the tear tape; in other words, to control both lateral edges of the tear tape (FIG. 8(*a*) is a plan view, and FIG. 8(*b*) is a side view). This arrangement not only allows the exterior wall members to serve as the pulling guide for the tear tape 17*b*, and the engagement guide for the toner storing container 12*a* and developing frame 12*b*, but also, helps to more effectively protect the corner portions of the developing frame 12*b*.

Further, instead of providing the exterior wall member 20, the engagement guide projection 21 and blind hole 22 may be provided along both of the lateral edges of the tear tape. Such an arrangement makes it easier to join the toner storing container 12*a* and developing frame 12*b*, and also, makes it possible to prevent the two components from becoming misaligned.

Further, the same effects as described in the foregoing can be obtained using the following manufacturing method; the exterior wall member 20, guide projection 21, and jaw-like projection 23, which constitute the engagement guide, are independently manufactured from the toner storing container 12*a* or developing frame 12*b*, and then, are attached to the toner storing container 12*a* and/or developing frame 12*b* by gluing or the like means.

Also, in the first embodiment, the opening regulating member 18 for regulating the size of the opening of the toner storing container 12*a* was provided, and the sealing member 17 was mounted on this opening regulating member 18. However, the provision of the opening regulating member is not mandatory for mounting the the sealing member 17 in accordance with the present invention; the sealing member 17 may be directly mounted on the toner storing container 12*a* to cover the opening thereof.

Also, in the first embodiment, the cover film 17*a* and tear tape 17*b* are integrated as the sealing member 17 so that the cover film 17*a* can be torn open by the tear tape 17*b*. However, the sealing member 17 may be constituted of a peelable seal member made of so-called easy-peel film.

Further, the photosensitive drum contained in the process cartridge is not limited to the one described in the preceding embodiment, and may include the following. As for the photosensitive material, photoconductive material is employed: for example, amorphous silicon, amorphous selenium, zinc oxide, titanium oxide, organic photoconductive compound (OPC) or the like. As for the configuration of the base member on which the photosensitive material is coated, the base member may be in the rotary form (drum) or sheet form (belt). Generally, it is in the form of a drum or a belt; for example, in the case of the photosensitive member in the drum form, the photoconductive material is coated on a cylinder of aluminum alloy by vapor deposition, painting, or the like means.

As for the developing means, it is also not limited to the one described above, and various well-known developing methods may be employed: for example, two component magnetic brush developing method, cascade developing method, touch-down developing method, cloud developing method, and the like.

As for the structure of the charging means, the so-called contact charging method was employed in the first embodiment. Needless to say, however, the following conventional structure may be employed instead, in which a metallic shield of aluminum or the like is disposed on three sides of a piece of tungsten wire, and the positive or negative ions, which are generated as a high voltage is applied to the tungsten wire, are transferred onto the surface of the photosensitive drum to charge uniformly the surface of the photosensitive drum.

As for the charging means, charging means of the blade (charging blade), pad, block, rod, wire, or the like type may be employed in addition to the roller type described above.

As for the method for cleaning the toner remaining on the photosensitive drum, the cleaning means may comprise a blade, a fur brush, a magnetic brush, or the like.

According to the present invention, the aforementioned process cartridge comprises an electro-photographic photosensitive member as the image bearing member, and at least, a developing means. Therefore, it may be in a form other than the one described in the preceding embodiment. For example, a combination of an image bearing member, a developing means, and a charging means; a combination of an image bearing member, a developing member, and a cleaning means; a combination of an image bearing member and a developing means; or the like combination, may be integrated into such a form of cartridge that is replaceably mountable in the apparatus main assembly.

Also, in the preceding embodiment, the image forming apparatus was exemplified by a laser beam printer, but it is unnecessary for the present invention to be limited by the embodiment; needless to say, the present invention is applicable to other image forming apparatus, such as an electrophotographic copying machine, a facsimile apparatus, or a word processor.

As was described above, the engagement guide was provided at the edge of the toner storing container and/or developing frame; therefore, it is possible to join the toner storing container and developing frame easily and without causing misalignment. Further, when the two components are combined, the sealing member for sealing the toner storing container is mounted on the opening regulating member, and then, the toner storing container and developing frame are joined, with this opening regulating member interposed; therefore, the toner storing container can be easily sealed.

Also, the distance between the corresponding pieces of the engagement guide is established to be substantially the same as the width of the sealing member, so that the engagement guide can be used as a guide for the sealing member when the sealing member is pulled out; therefore, the sealing member can be reliably pulled out. Further, when the exterior wall member is formed, as the engagement guide, at the corner portion of the toner storing container, it protects the corner portions of the toner storing container and developing frame; therefore, a process cartridge with improved shock resistance can be produced.

Further, the projection is provided on the downstream side of the end seal provided for preventing the toner from leaking from between the toner storing container and developing frame, relative to the direction in which the sealing member is pulled out; therefore, it is possible to more reliably prevent the toner from leaking from between the toner storing container and developing frame.

Thus, when a process cartridge is manufactured so as to comprise the developing apparatus having the structure described above, the preciseness of the cartridge can be easily improved while improving the shock-resistance and leak-resistance of the cartridge. Further, when such a cartridge is mounted in an image forming apparatus such as a copying machine or a printer, clear and brilliant images can be recorded with low running costs.

As will be evident from the above description, according to the present invention, the developing frame and toner frame can be easily joined together.

While the invention has been described with reference to the structures disclosed herein, it is not confined to the details set forth, and this application is intended to cover such modifications or changes as may come within the purposes of the improvements or the scope of the following claims.

What is claimed is:

1. A frame for a developing device for a process cartridge detachably mountable to a main assembly of an image forming apparatus, said frame comprising:

a developing frame having a mounting portion for mounting a developing roller for developing a latent image formed on an electrophotographic photosensitive member, said developing frame having a projection on a side opposed from a side provided with said mounting portion, said projection being disposed longitudinally outside an elastic seal provided adjacent one longitudinal end of said developing frame to prevent leakage of toner;

a toner frame having a toner container portion for containing toner usable for a developing operation of the developing roller, said toner frame having a toner supply opening for supplying toner to the developing roller and a recess adjacent a longitudinal end of said toner supply opening; and a toner seal provided with said toner frame for openably sealing said toner supply opening, wherein said projection and said recess are engageable with each other to couple said developing frame and said toner frame, and wherein said toner seal is removed with a removal direction thereof being limited by said projection engaged with said recess.

2. A frame according to claim 1, wherein another elastic seal is provided at another longitudinal end of said developing frame opposite said one longitudinal end, and said elastic seals are effective to prevent leakage of the toner through an area between said developing frame and said toner frame when said developing frame and said toner frame are coupled with each other.

3. A frame for a developing device for a process cartridge detachably mountable to a main assembly of an image forming apparatus, said frame comprising:

a developing frame having a mounting portion for mounting a developing roller for developing a latent image formed on an electrophotographic photosensitive member, said developing frame having a projection on a side opposed from a side provided with said mounting portion;

a toner frame having a toner container portion for containing toner usable for a developing operation of the developing roller, said toner frame having an opening for supplying toner to the developing roller and a recess adjacent a longitudinal end of said opening;

wherein said projection and said recess are engageable with each other to couple said developing frame and said toner frame; wherein said toner frame is provided with a toner seal for sealing said opening; wherein said recess is provided downstream of said opening with respect to a pulling direction of said toner seal; wherein said toner seal is removed to open said opening before start of use of the process cartridge; wherein said toner seal is mounted to a limiting plate for limiting an open area of said opening; and wherein the limiting plate is mounted to said toner frame so that said toner seal is mounted to said toner frame.

4. A frame according to claim 3, wherein said toner seal has a cover film and a tear tape for tearing said cover film to open said toner supply opening.

5. A frame according to claim 3 or 4, wherein when said developing frame and said toner frame are coupled with each other, said toner seal is removed with the pulling direction thereof being limited by said projection engaged with said recess, and wherein a part of said projection contactable with said toner seal is arcuated.

6. A frame according to claim 1, 2, 3, or 4, wherein said developing frame and said toner frame are coupled by ultrasonic wave fusing.

7. A developing apparatus usable with a process cartridge detachably mountable to a main assembly of an image forming apparatus, said developing apparatus comprising:

a developing roller for developing a latent image formed on an electrophotographic photosensitive member;

a developing frame having a mounting portion mounting said developing roller to said developing frame and a projection on a side opposite from a side provided with said developing roller, said projection being disposed longitudinally outside an elastic seal provided adjacent one longitudinal end of said developing frame to prevent leakage of toner;

a toner frame having a toner container portion for containing toner usable for a developing operation of said developing roller, said toner frame having a toner supply opening for supplying toner to said developing roller and a recess adjacent a longitudinal end of said toner supply opening; and a toner seal provided with said toner frame for openably sealing said toner supply opening, said toner seal being removed prior to start of use of the process cartridge to open said toner supply opening, wherein said projection and said recess are engageable with each other to couple said developing frame and said toner frame, and wherein said toner seal is removed with a removal direction thereof being limited by said projection engaged with said recess.

8. A developing apparatus according to claim 7, wherein another elastic seal is provided at another longitudinal end of said developing frame opposite said one longitudinal end, and said elastic seals are effective to prevent leakage of the toner through an area between said developing frame and said toner frame when said developing frame and said toner frame are coupled with each other.

9. A developing apparatus according to claim 7, wherein said recess is disposed downstream of said toner supply opening with respect to a pulling direction of said toner seal, wherein said toner seal is removed to open said toner supply opening before start of use of the process cartridge, and said toner seal is mounted to a limiting plate for limiting an open area of said toner supply opening, and the limiting plate is mounted to said toner frame so that said toner seal is mounted to said toner frame.

10. A developing apparatus according to claim 7 or 9, wherein said toner seal has a cover film and a tear tape for tearing said cover film to open said toner supply opening.

11. A developing apparatus according to claim 8 or 9, wherein when said developing frame and said toner frame are coupled with each other, said toner seal is removed with the pulling direction thereof being limited by said projection engaged with said recess, and wherein a part of said projection contactable with said toner seal is arcuated.

12. A developing apparatus according to claim 7, wherein said developing frame and said toner frame are coupled by ultrasonic wave fusing.

13. A developing apparatus according to claim 7 or 12, further comprising a blade for regulating an amount of toner deposited on a peripheral surface of said developing roller.

14. A process cartridge detachably mountable to a main assembly of an image forming apparatus, said process cartridge comprising:

an electrophotographic photosensitive member; and a developing device including a developing roller for developing a latent image formed on said electrophotographic photosensitive member; a developing frame having a mounting portion mounting said developing roller to said developing frame and a projection on a side opposite from a side provided with said developing roller, said projection being disposed longitudinally outside an elastic seal provided adjacent one longitudinal end of said developing frame to prevent leakage of toner; a toner frame having a toner container portion for containing toner usable for a developing operation of said developing roller, said toner frame having a toner supply opening for supplying toner to said developing roller and a recess adjacent a longitudinal end of said toner supply opening; and a toner seal provided with said toner frame for openably sealing said toner supply opening, said toner seal being removed prior to start of use of said process cartridge to open said toner supply opening, wherein said projection and said recess are engageable with each other to couple said developing frame and said toner frame, and wherein said toner seal is removed with a removal direction thereof being limited by said projection engaged with said recess.

15. A process cartridge according to claim 14, wherein another elastic seal is provided at another longitudinal end of said developing frame opposite said one longitudinal end, and said elastic seals are effective to prevent leakage of the toner through an area between said developing frame and said toner frame when said developing frame and said toner frame are coupled with each other.

16. A process cartridge according to claim 13, wherein said recess is disposed downstream of said toner supply opening with respect to a pulling direction of said toner seal, wherein said toner seal is removed to open said toner supply opening before start of use of said process cartridge, and said toner seal is mounted to a limiting plate for limiting an open area of said toner supply opening, and the limiting plate is mounted to said toner frame so that said toner seal is mounted to said toner frame.

17. A process cartridge according to claim 14 or 16, wherein said toner seal has a cover film and a tear tape for tearing said cover film to open said toner supply opening.

18. A process cartridge according to claim 15 or 16, wherein when said developing frame and said toner frame are coupled with each other, said toner seal is removed with the pulling direction thereof being limited by said projection engaged with said recess, and wherein a part of said projection contactable with said toner seal is arcuated.

19. A process cartridge according to claim 16, wherein said developing frame and said toner frame are coupled by ultrasonic wave fusing.

20. A process cartridge according to claim 14, further comprising charging means for charging said photosensitive member.

21. A process cartridge according to claim 14, further comprising cleaning means for removing residual toner on said photosensitive member.

22. A process cartridge detachably mountable to a main assembly of an image forming apparatus, said process cartridge comprising:

an electrophotographic photosensitive member;

a developing device including a developing roller for developing a latent image formed on said electrophotographic photosensitive member; a developing frame having a mounting portion mounting said developing roller to said developing frame and a projection on a side opposite from a side provided with said developing roller; a toner frame having a toner container portion for containing toner usable for a developing operation of said developing roller, said toner frame having an opening for supplying toner to said developing roller and a recess adjacent a longitudinal end of said opening; and a toner seal provided with said toner frame for openably sealing said opening, said toner seal being removed prior to start of use of said process cartridge to open said opening; and an outer wall member in said toner frame adjacent a corner from which said toner seal is pulled, said outer wall member limiting a pulling direction of said toner seal, wherein said projection and said recess are engageable with each other to couple said developing frame and said toner frame.

23. A process cartridge detachably mountable to a main assembly of an image forming apparatus, said process cartridge comprising:

an electrophotographic photosensitive member; and a developing device including a developing roller for developing a latent image formed on said electrophotographic photosensitive member; a developing frame having a mounting portion mounting said developing roller to said developing frame and a projection on a side opposite from a side provided with said developing roller; a toner frame having a toner container portion for containing toner usable for a developing operation of said developing roller, said toner frame having an opening for supplying toner to said developing roller and a recess adjacent a longitudinal end of said opening; and a toner seal provided with said toner frame for openably sealing said opening, said toner seal being removed prior to start of use of said process cartridge to open said opening, wherein said developing frame has a second projection in a pulling region of said toner seal, wherein said second projection narrows a clearance between said developing frame and said toner frame to prevent leakage of the toner through the clearance, and wherein said projection and said recess are engageable with each other to couple said developing frame and said toner frame.

24. An image forming apparatus, for forming an image on a recording material, to which a process cartridge is detachably mountable, said image forming apparatus comprising:

mounting means for detachably mounting a process cartridge including an electrophotographic photosensitive member; a developing device including a developing roller for developing a latent image formed on the electrophotographic photosensitive member; a developing frame having a mounting portion mounting the developing roller to the developing frame and a projection on a side opposite from a side provided with the mounting portion, the projection being disposed longitudinally outside an elastic seal provided adjacent one longitudinal end of the developing frame to prevent leakage of toner; a toner frame having a toner container portion for containing toner usable for a developing operation of the developing device, the toner frame having a toner supply opening for supplying toner to the developing device and a recess adjacent a longitudinal end of the toner supply opening; and a toner seal provided with the toner frame for openably sealing the toner supply opening, the toner seal being removed prior to start of use of the process cartridge to open the toner supply opening; wherein the projection and the recess are engageable with each other to couple the developing frame and the toner frame, and wherein the toner seal is removed with a removal direction thereof being limited by the projection engaged with the recess; and feeding means for feeding the recording material.

25. A frame for a developing device for a process cartridge detachably mountable to a main assembly of an image forming apparatus, said frame comprising:

a developing frame having a mounting portion for mounting a developing roller for developing a latent image formed on an electrophotographic photosensitive member, said developing frame having a projection on a side opposed from a side provided with said mounting portion, wherein said projection is disposed longitudinally outside an elastic seal provided adjacent a longitudinal end of said developing frame;

a toner frame having a toner container portion for containing toner usable for a developing operation of said developing roller, said toner frame having an opening for supplying toner to said developing roller and a recess adjacent a longitudinal end of said opening; and a toner seal for sealing said opening, said recess being provided downstream of said opening with respect to a pulling direction of said toner seal, wherein said toner seal is removed to open said opening before start of use of the process cartridge, and said toner seal is mounted to a limiting plate for limiting an open area of said opening, and the limiting plate is mounted to said toner frame so that said toner seal is mounted to said toner frame, wherein said projection and said recess are engageable with each other to couple said developing frame and said toner frame with the elastic seal therebetween.

26. A frame according to claim 25, wherein another elastic seal is provided at another longitudinal end of said developing frame opposite said one longitudinal end, and said elastic seals are effective to prevent leakage of the toner through an area between said developing frame and said toner frame when said developing frame and said toner frame are coupled with each other.

27. A frame according to claim 25 or 26, wherein said toner seal has a cover film and a tear tape for tearing said cover film to open said opening.

28. A frame according to claim 25 or 26, wherein when said developing frame and said toner frame are coupled with each other, said toner seal is removed with the pulling direction thereof being limited by said projection engaged with said recess, and wherein a part of said projection contactable with said toner seal is arcuated.

29. A frame according to claim 25 or 26, wherein said developing frame and said toner frame are coupled by ultrasonic wave fusing.

30. A developing apparatus usable with a process cartridge detachably mountable to a main assembly of an image forming apparatus, said apparatus comprising:

a developing roller for developing a latent image formed on an electrophotographic photosensitive member;

a developing frame having a mounting portion mounting said developing roller, to said developing frame, for developing a latent image formed on the electrophotographic photosensitive member, said developing frame having a projection on a side opposed from a side provided with said mounting portion, wherein said projection is disposed longitudinally outside an elastic seal provided adjacent a longitudinal end of said developing frame;

a toner frame having a toner container portion for containing toner usable for a developing operation of said developing roller, said toner frame having an opening for supplying toner to said developing roller and a recess adjacent a longitudinal end of said opening; and a toner seal for sealing said opening, said recess being provided downstream of said opening with respect to a pulling direction of said toner seal, wherein said toner seal is removed to open said opening before start of use of the process cartridge, and said toner seal is mounted to a limiting plate for limiting an open area of said opening, and the limiting plate is mounted to said toner frame so that said toner seal is mounted to said toner frame, wherein said projection and said recess are engageable with each other to couple said developing frame and said toner frame with the elastic seal therebetween.

31. An apparatus according to claim 30, wherein another elastic seal is provided at another longitudinal end of said developing frame opposite said one longitudinal end, and said elastic seals are effective to prevent leakage of the toner through an area between said developing frame and said toner frame when said developing frame and said toner frame are coupled with each other.

32. An apparatus according to claim 30 or 31, wherein said toner seal has a cover film and a tear tape for tearing said cover film to open said opening.

33. An apparatus according to claim 30 or 31, wherein when said developing frame and said toner frame are coupled with each other, said toner seal is removed with the pulling direction thereof being limited by said projection engaged with said recess, and wherein a part of said projection contactable with said toner seal is arcuated.

34. An apparatus according to claim 30, wherein said developing frame and said toner frame are coupled by ultrasonic wave fusing.

35. An apparatus according to claim 31 or 34, further comprising a blade for regulating an amount of toner deposited on a peripheral surface of said developing roller.

36. A process cartridge detachably mountable to a main assembly of an image forming apparatus, said process cartridge comprising:

an electrophotographic photosensitive member;

a developing device including a developing roller for developing a latent image formed on said electrophotographic photosensitive member and a developing frame having a mounting portion mounting said developing roller to said developing frame, said developing frame having a projection on a side opposed from a side provided with said mounting portion, wherein said projection is disposed longitudinally outside an elastic seal provided adjacent a longitudinal end of said developing frame;

a toner frame having a toner container portion for containing toner usable for a developing operation of said developing device, said toner frame having an opening for supplying toner to said developing device and a recess adjacent a longitudinal end of said opening; and a toner seal for sealing said opening, said recess being provided downstream of said opening with respect to a pulling direction of said toner seal, wherein said toner seal is removed to open said opening before start of use of said process cartridge, and said toner seal is mounted to a limiting plate for limiting an open area of said opening, and the limiting plate is mounted to said toner frame so that said toner seal is mounted to said toner frame, wherein said projection and said recess are engageable with each other to couple said developing frame and said toner frame with the elastic seal therebetween.

37. A process cartridge according to claim 36, wherein another elastic seal is provided at another longitudinal end of said developing frame opposite said one longitudinal end, and said elastic seals are effective to prevent leakage of the toner through an area between said developing frame and said toner frame when said developing frame and said toner frame are coupled with each other.

38. A process cartridge according to claim 36 or 37, wherein said toner seal has a cover film and a tear tape for tearing said cover film to open said opening.

39. A process cartridge according to claim 36 or 37, wherein when said developing frame and said toner frame are coupled with each other, said toner seal is removed with the pulling direction thereof being limited by said projection engaged with said recess, and wherein a part of said projection contactable with said toner seal is arcuated.

40. A process cartridge according to claim 36, wherein said developing frame and said toner frame are coupled by ultrasonic wave fusing.

41. A process cartridge according to claim 36, further comprising charging means for charging said photosensitive member.

42. A process cartridge according to claim 36 or 41, further comprising cleaning means for removing residual toner on said photosensitive member.

43. A process cartridge according to claim 36, further comprising an outer wall member in said toner frame adjacent a corner from which said toner seal is pulled, said outer wall member limiting the pulling direction of said toner seal.

44. A process cartridge according to claim 36, wherein said developing frame has a second projection in a pulling region of said toner seal, and wherein said second projection narrows a clearance between said developing frame and said toner frame to prevent leakage of the toner through the clearance.

45. An image forming apparatus, for forming an image on a recording material, to which a process cartridge is detachably mountable, said image forming apparatus comprising:

mounting means for detachably mounting a process cartridge including an electrophotographic photosensitive member; a developing device including a developing roller for developing a latent image formed on the electrophotographic photosensitive member; a developing frame having a mounting portion mounting the developing roller to the developing frame, the developing frame having a projection on a side opposed from a side provided with the mounting portion, wherein the projection is disposed longitudinally outside an elastic seal provided adjacent a longitudinal end of the developing frame; a toner frame having a toner container portion for containing toner usable for a developing operation of the developing roller, the toner frame having an opening for supplying toner to the developing roller and a recess adjacent a longitudinal end of the opening; and a toner seal for sealing the opening, the recess being provided downstream of the opening with respect to a pulling direction of the toner seal, wherein the toner seal is removed to open the opening before start of use of the process cartridge, and the toner seal is mounted to a limiting plate for limiting an open area of the opening, and the limiting plate is mounted to the toner frame so that the toner seal is mounted to the toner frame, wherein the projection and the recess are engageable with each other to couple the developing frame and the toner frame with the elastic seal therebetween; and feeding means for feeding the recording material.

46. A developing apparatus usable with a process cartridge detachably mountable to a main assembly of an image forming apparatus, said developing apparatus comprising:

a developing roller for developing a latent image formed on an electrophotographic photosensitive member;

a developing frame having a mounting portion mounting said developing roller to said developing frame, and a projection on a side opposite from a side provided with said developing roller;

a toner frame having a toner container portion for containing toner usable for a developing operation of said developing roller, said toner frame having an opening for supplying toner to said developing roller and a recess adjacent a longitudinal end of said opening; and a toner seal provided with said toner frame for openably sealing said opening, said toner seal being removed prior to start of use of the process cartridge to open said opening, wherein said projection and said recess are engageable with each other to couple said developing frame and said toner frame; wherein, when said developing frame and said toner frame are coupled with each other, said toner seal is removed with a removal direction thereof being limited by said projection engaged with said recess; and wherein a part of said projection contactable with said toner seal is arcuated.

47. A process cartridge detachably mountable to a main assembly of an image forming apparatus, said process cartridge comprising:

an electrophotographic photosensitive member; and a developing device including a developing roller for developing a latent image formed on said electrophotographic photosensitive member; a developing frame having a mounting portion mounting said developing roller to said developing frame, and a projection on a side opposite from a side provided with said developing roller; a toner frame having a toner container portion for containing toner usable for a developing operation of said developing roller, said toner frame having an opening for supplying toner to said developing roller and a recess adjacent a longitudinal end of said opening; and a toner seal provided with said toner frame for openably sealing said opening, said toner seal being removed prior to start of use of said process cartridge to open said opening; wherein said projection and said recess are engageable with each other to couple said developing frame and said toner frame; wherein, when said developing frame and said toner frame are coupled with each other, said toner seal is removed with a removal direction thereof being limited by said projection engaged with said recess; and wherein a part of said projection contactable with said toner seal is arcuated.

* * * * *

UNITED STATES PATENT AND TRADEMARK OFFICE

CERTIFICATE OF CORRECTION

PATENT NO. : 5,689,772
DATED : November 18, 1997
INVENTOR(S) : Yasuo FUJIWARA, et al.

It is certified that error appears in the above-identified patent and that said Letters Patent is hereby corrected as shown below:

Column 1, lines 41 and 42, delete "having been";
Line 43, delete "into" and insert therefor --to--.

Column 2, line 16, delete "the".

Column 3, line 21, delete "the", second occurrence;
Line 65, delete "passed" and insert therefor --passes--.

Column 6, line 48, delete "incidence" and insert therefor --incident--;
Line 65, delete "taped" and insert therefor --tape--;
Line 67, delete "the".

Column 7, line 4, delete "the";
Line 30, delete the semicolon (";") and insert therefor a period (".");
Line 32, delete "are", first occurrence.

UNITED STATES PATENT AND TRADEMARK OFFICE

CERTIFICATE OF CORRECTION

PATENT NO. : 5,689,772
DATED : November 18, 1997
INVENTOR(S) : Yasuo FUJIWARA, et al.

It is certified that error appears in the above-identified patent and that said Letters Patent is hereby corrected as shown below:

Column 12, line 44, delete "13" and insert therefor --14--;
Line 62, delete "16" and insert therefor --14--.

Signed and Sealed this
Twelfth Day of May, 1998

*Attest:*

*Attesting Officer*

BRUCE LEHMAN

*Commissioner of Patents and Trademarks*